US007188994B2

(12) United States Patent
Poo et al.

(10) Patent No.: US 7,188,994 B2
(45) Date of Patent: Mar. 13, 2007

(54) ORBITAL SHAKER FOR CELL EXTRACTION

(75) Inventors: Ramon E. Poo, Miami, FL (US); Camillo Ricordi, Miami, FL (US)

(73) Assignees: Biorep Technologies, Inc., Miami, FL (US); University of Miami, Miami, FL (US)

( * ) Notice: Subject to any disclaimer, the term of this patent is extended or adjusted under 35 U.S.C. 154(b) by 0 days.

(21) Appl. No.: 10/372,722

(22) Filed: Feb. 24, 2003

(65) Prior Publication Data

US 2004/0022120 A1 Feb. 5, 2004

Related U.S. Application Data

(60) Provisional application No. 60/359,298, filed on Feb. 22, 2002.

(51) Int. Cl.
*B01F 11/00* (2006.01)

(52) U.S. Cl. ..... 366/187; 366/216; 366/218

(58) Field of Classification Search ..... 366/209, 366/210, 211, 212, 216, 217, 218, 208, 187, 366/188; 422/99, 184.1, 209, 224
See application file for complete search history.

(56) References Cited

U.S. PATENT DOCUMENTS 982,156 A * 1/1911 Miltz ..... 366/216
1,382,181 A * 6/1921 Emery ..... 366/111
1,489,024 A * 4/1924 Burnett ..... 366/209
2,206,669 A * 7/1940 Kowalski ..... 366/216
2,323,403 A * 7/1943 Jorgenson ..... 366/209
2,520,556 A * 8/1950 Massey ..... 366/209
2,527,556 A * 10/1950 Kost ..... 366/209
2,671,648 A * 3/1954 Kost ..... 366/209
2,710,742 A * 6/1955 Vlock ..... 366/209
2,804,777 A * 9/1957 Kerr-Lawson ..... 366/217
3,181,841 A * 5/1965 Boehm ..... 366/211
3,275,302 A * 9/1966 Horton ..... 366/209
3,748,249 A * 7/1973 Barton ..... 366/226
4,669,225 A * 6/1987 Kuster ..... 451/326
4,775,242 A * 10/1988 Bohle ..... 366/209
5,079,160 A 1/1992 Lacy et al.
5,269,827 A * 12/1993 Lenke et al. ..... 65/178
5,360,265 A * 11/1994 Cruse ..... 366/208
5,464,773 A * 11/1995 Melendez et al. ..... 435/306.1
5,697,701 A * 12/1997 Forrest et al. ..... 366/110
6,039,557 A * 3/2000 Unger et al. ..... 366/208
6,494,611 B2 * 12/2002 Edwards et al. ..... 366/209
6,626,912 B2 * 9/2003 Speitling ..... 366/209

OTHER PUBLICATIONS

Drawings of previous models of orbital shaker for cell extraction: Wshaker, Wshaker-B, and Wshaker-2, RAFA—Machinery & Engineering Co., Miami, Florida, 10 sheets: Sept. 01, 1997; Jun. 24, 1999; Nov. 15, 2000.

* cited by examiner

*Primary Examiner*—Tony G. Soohoo
(74) *Attorney, Agent, or Firm*—Akerman Senterfitt

(57) ABSTRACT

A orbital shaker for cell extraction includes a digestion chamber and structure for translating the digestion chamber. Structure is also provided for rotating the digestion chamber. A method of performing cell extraction is also disclosed.

11 Claims, 8 Drawing Sheets

ORBITAL SHAKER FOR CELL EXTRACTION

CROSS-REFERENCE TO RELATED APPLICATIONS

This application claims priority from U.S. Provisional Application No. 60/359,298, filed Feb. 22, 2002. The foregoing is incorporated herein by reference.

STATEMENT REGARDING FEDERALLY SPONSORED RESEARCH OR DEVELOPMENT

Not applicable.

BACKGROUND OF THE INVENTION

Scientists are currently researching possible applications for isolated cells from parent organs, such as the liver, spleen, kidney, adrenal, and pancreas. Some research that has been conducted on the clinical application of isolated cells has involved groups of cells called the Islets of Langerhans that have been isolated from the pancreas. An application for the Islet of Langerhans cells is as a treatment for diabetic patients. Patients with diabetes have Islets of Langerhans that do not function properly, and therefore, do not produce enough insulin. Some clinical research is aimed at developing a procedure for transplanting functioning Islets of Langerhans into diabetic patients to restore the insulin producing ability of the pancreas. Clinical research of such requires isolated Islet of Langerhans cells, but these cells must be isolated while still viable. Viable isolated cells are mostly obtained from organs of the very recently deceased. The apparatus and method for isolating the cells should be able to extract isolated cells with as little damage to the cells as possible.

Many different methods and approaches have been attempted to isolate individual cells from their respective parent organs. Prior methods have produced isolated cells with some cell destruction. This cell destruction can result from the relatively severe mechanical stimulation that is used to isolate cells from an organ.

One method that attempts to overcome the loss of damaged cells due to relatively severe mechanical stress is described in U.S. Pat. No. 5,079,160, to Lacy, et al. The method disclosed by Lacy, et al. comprises the steps of: placing an organ or a piece of an organ in a digestion chamber along with marble agitators; distending the organ or a piece of the organ with physiologically compatible medium containing a protease; continuously recirculating that medium; and separating the isolated cells. The marble agitators greatly increase the amount of undamaged cells obtained through isolation without reducing the quality of the isolated cells obtained by gently agitating the organ. Moreover, the marbles are an appropriate size, weight, and density for obtaining beneficial results as compared to other agitators of varying size, weight, and density which can cause severe mechanical disruption of the organ tissue resulting in some cells being destroyed.

SUMMARY OF THE INVENTION

An orbital shaker for cell extraction, includes an engagement structure for engaging a digestion chamber; a translational drive structure for translating the digestion chamber; and rotational drive structure for rotating the digestion chamber.

A method for cell extraction includes the steps of providing tissue in a digestion chamber; supplying a digestive medium to the digestion chamber; and using an orbital shaker apparatus to translate the digestion chamber while rotating the digestion chamber.

BRIEF DESCRIPTION OF THE DRAWINGS

There is shown in the drawings embodiments which are presently preferred, it being understood, however, that the invention can be embodied in other forms without departing from the spirit or essential attributes thereof.

DETAILED DESCRIPTION OF THE INVENTION

Figure 1:
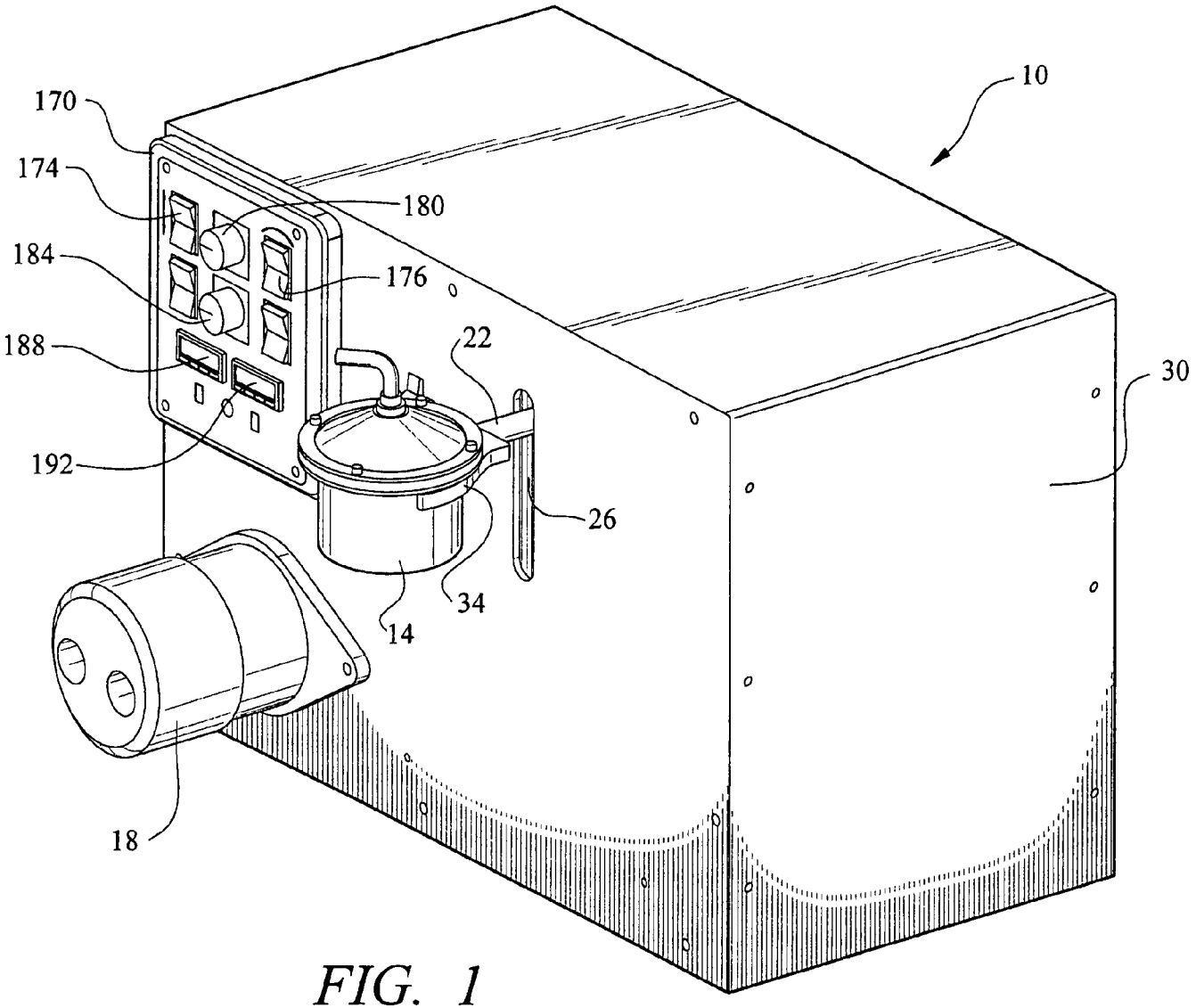
FIG. 1 is a perspective view of a orbital shaker for cell extraction.
Figure 2:
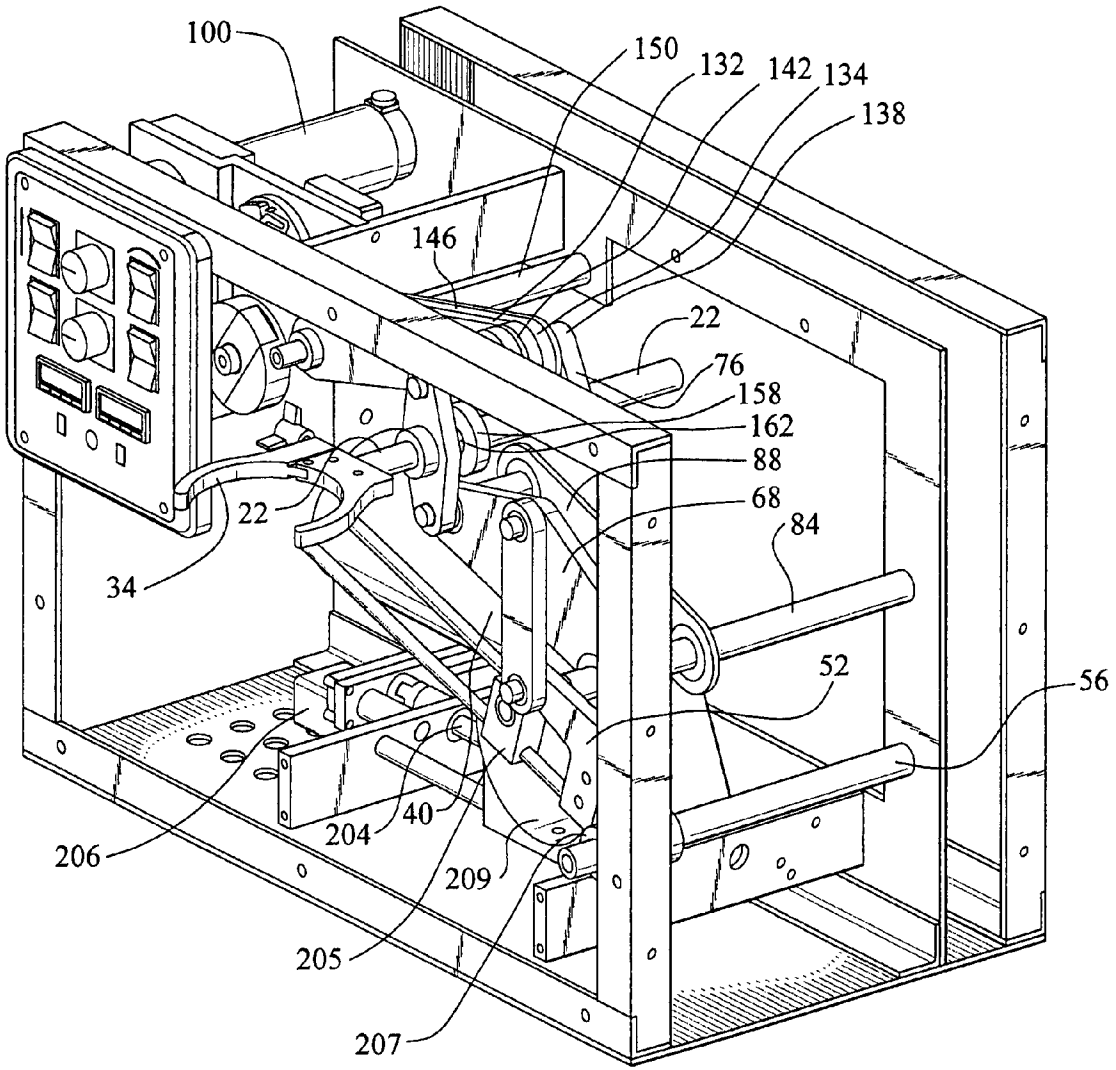
FIG. 2 is a perspective view, with an external housing removed to show internal features.
Figure 3:
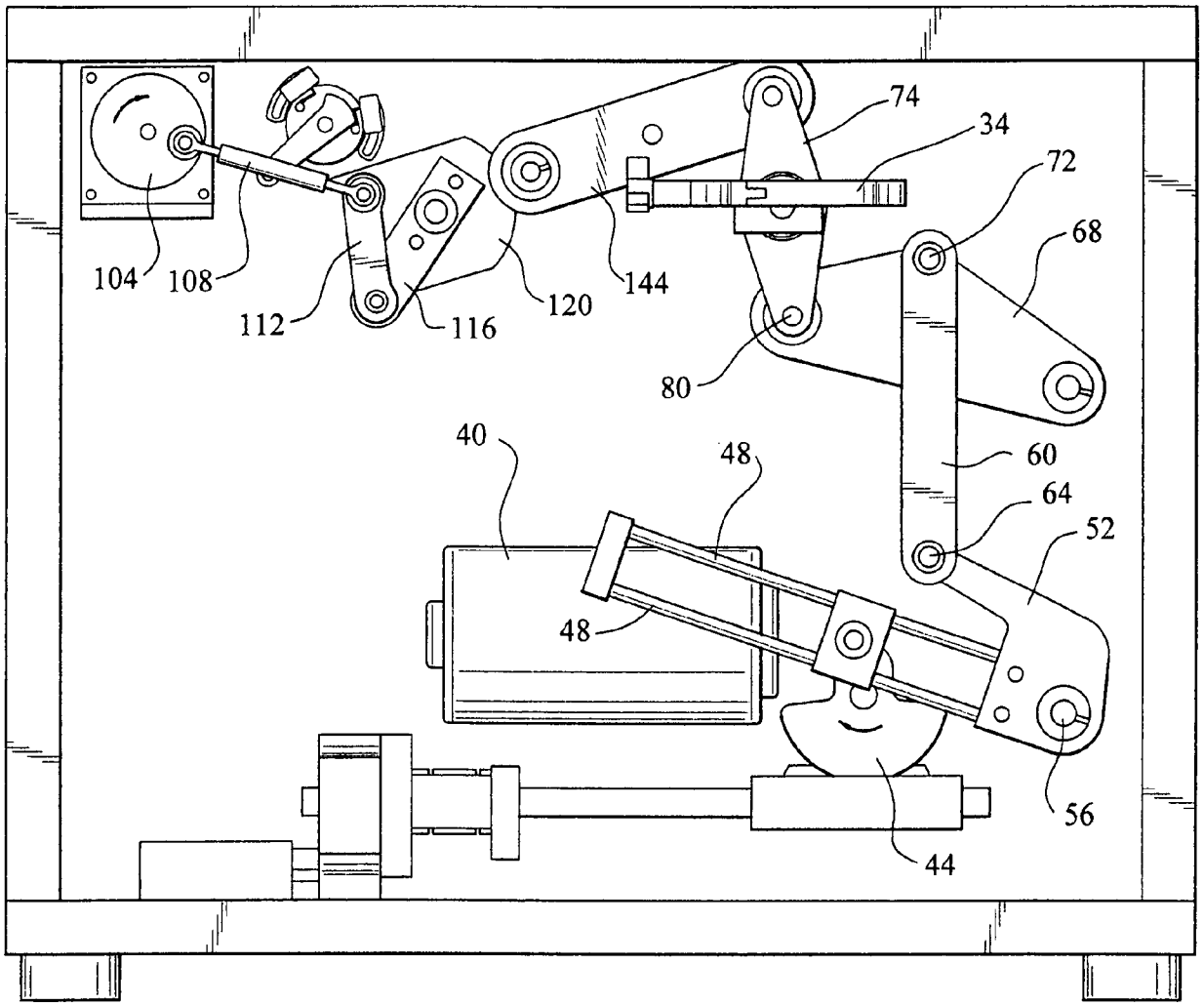
FIG. 3 is a front elevation view.
Figure 4:
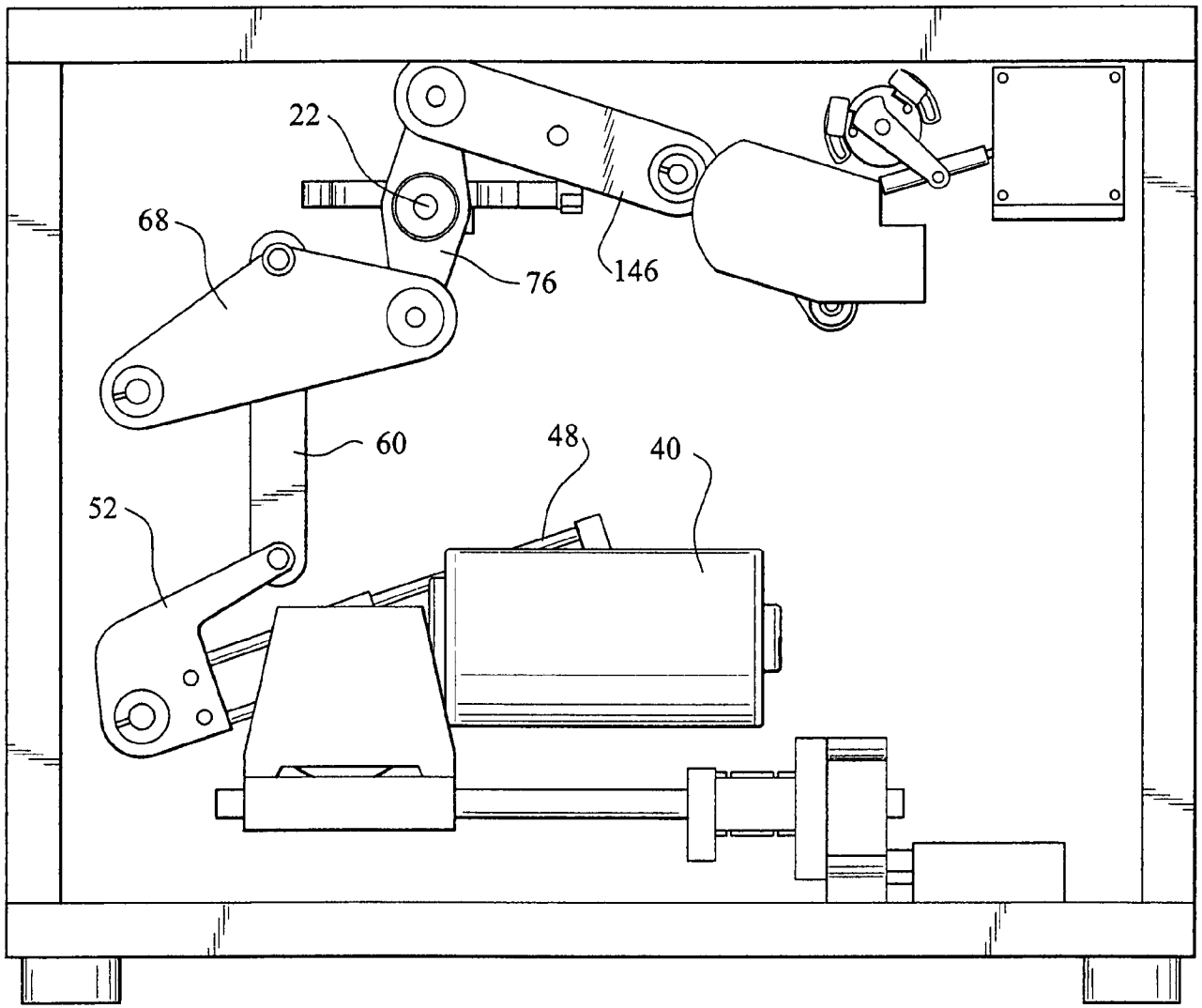
FIG. 4 is a rear elevation view.
Figure 5:
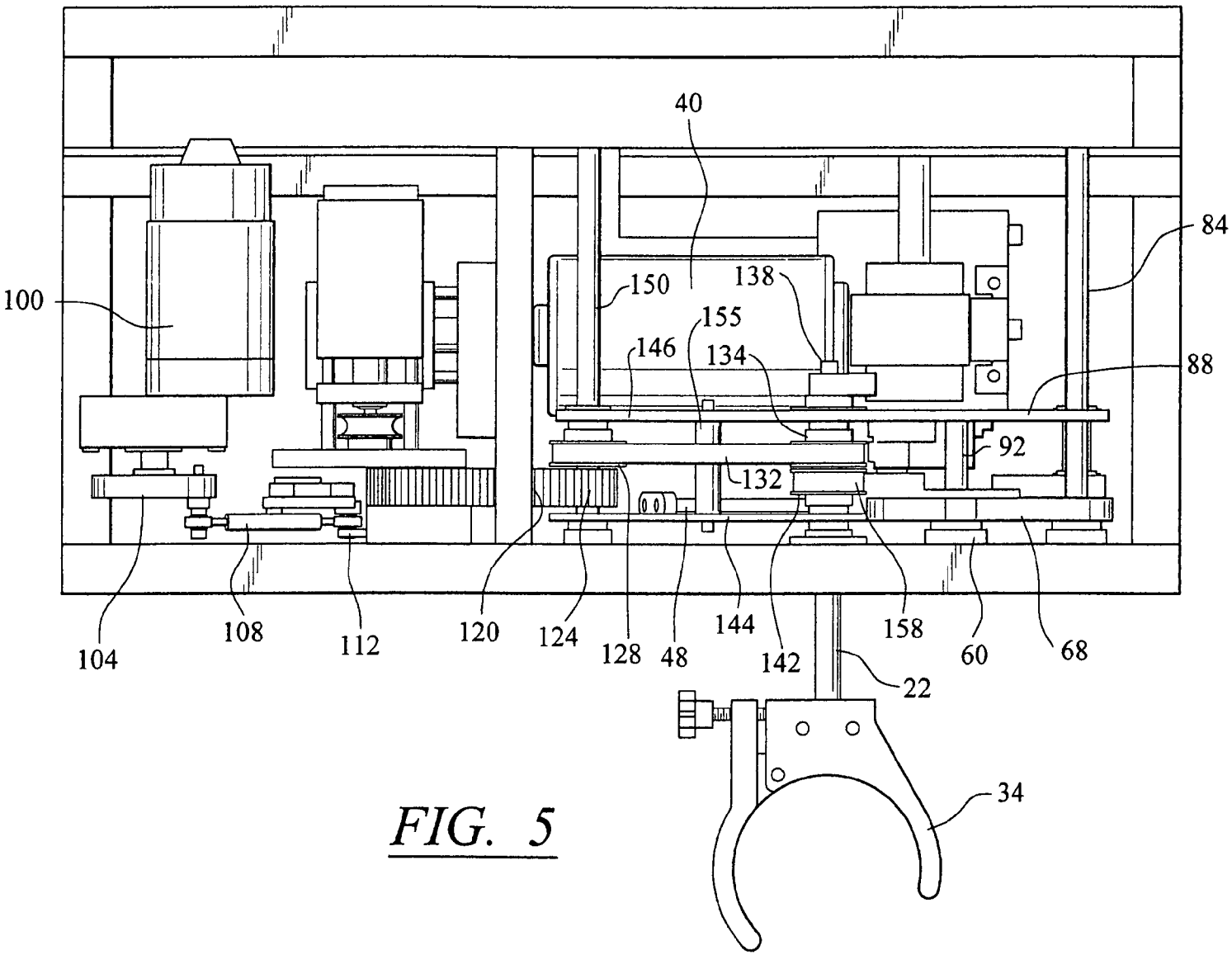
FIG. 5 is a top plan view.
Figure 6:
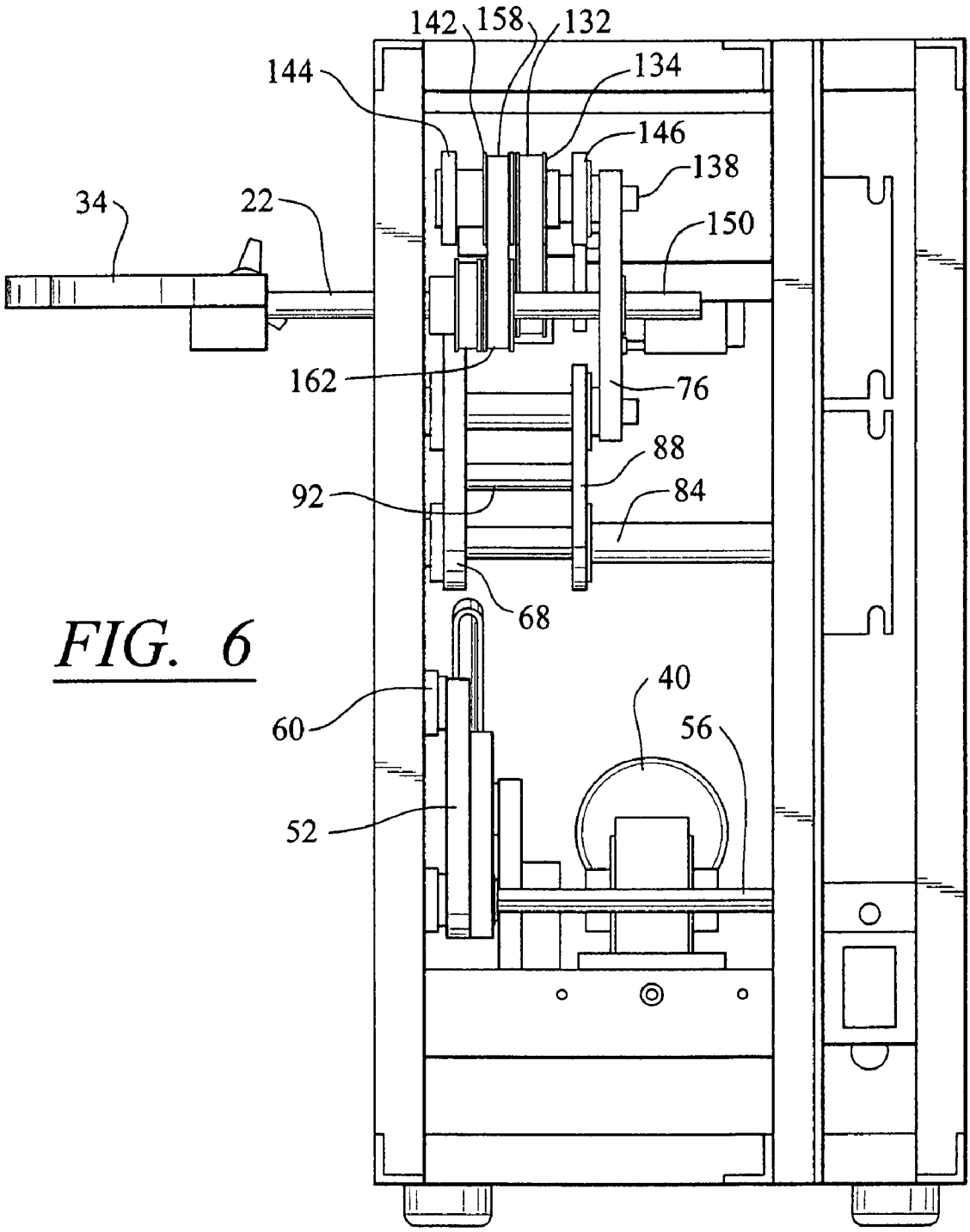
FIG. 6 is a left side elevation view.
Figure 7:
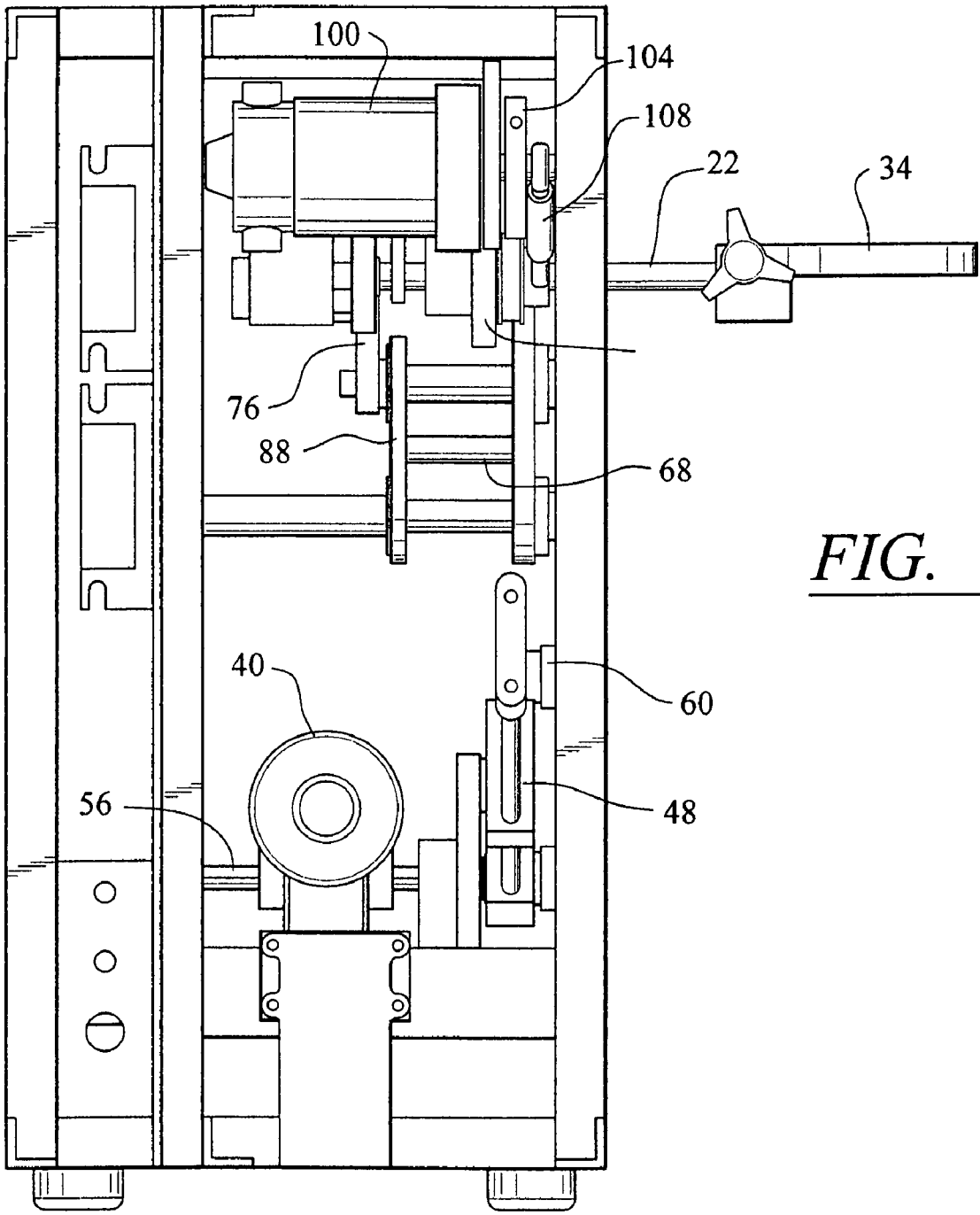
FIG. 7 is a right side elevation view.

Organ and tissue dissociation procedures require a combination of enzymatic or chemical reagents in a solution (at a certain temperature that is optimal for the effect of the selected reagent) and mechanical forces, to enhance the tissue disaggregation and dispersion process into progressively smaller tissue fragments, clusters of cells and even single cell products.

The mechanical action is generally performed by digestion chambers that contain digestion enhancers such as marbles. The organ or tissue is placed into the selected chamber with the digestion solution (e.g., containing collagenase or specific enzyme blends). In order to mix evenly the solution and evenly increase the temperature to the desired target range, as well as to enhance the mechanical tissue dispersion within the digestion chamber, a double action (rotational and translational), variable speed and variable rate shaker is used to replace the manual movement currently utilized in several tissue processing facilities, for example to process human pancreata for the production of human islets for transplantation or research applications.

The invention has been developed to provide the necessary shaking of the chamber in a consistent and automated vertical and/or rotational manner during the isolation of beta cells from the digestion of a pancreas or of other cells from other tissues or organs. The double action (rotational and translational movement), variable speed and variable rate shaker replaces the existing shaking of the chamber by human hands which cannot provide the consistency and speed required to obtain more desirable results during the digestion of the pancreas. This shaker can perform virtually an unlimited combination of motion movements at different amplitudes and frequencies, making it an excellent machine to apply the different movements and strengths of mechanical forces that are needed during an organ and tissue dispersion process. This is particularly important because of the great variability in organ characteristics with age, conditions of the tissue and several other variables including but not limited to organ procurement, body mass composition of the donor, preservation solution, cold ischemia time before processing and the like. It is therefore critically important for the operator to be able to change the movement and the intensity of the mechanical enhancing process during tissue and organ digestion processes.

The vertical motion is controlled by a straight line Watts mechanism driven by an electric motor. The rotational movement is controlled by a separate motor connected to several linkages. Both the amplitude of the translational and rotational movement can be adjusted individually depending on the required movement of the chamber throughout the progress of the digestion of the pancreas in the chamber.

This ability to modify the amplitude, rate and combined (translational and rotational) movement of the shaker is very important even for an individual organ or tissue processing, at different times during the digestion process. For example in the case of pancreas digestion the movement is more gentle at the beginning of the process and increases in the final stages of the tissue dispersion procedure. These requirements also change when organs of different species are processed. For example, porcine islet separation from porcine pancreata requires a more gentle dissociation process compared to human pancreas processing.

The translational motion can be in any direction. In one aspect, the translational motion is a reciprocal motion in a substantially vertical plane. The reciprocal motion can be substantially vertical.

The rotational motion is imparted to the digestion chamber preferably while the digestion chamber is translating so as to provide optimal cell extraction.

Structure is preferably provided for varying the translational and rotational speed and distance. In one aspect, the translational motion is between about 1" and about 5", preferably 1.8"–4.2". The vertical oscillation frequency can be between 0 and 250 cycles per minute. The rotational motion can be between 0° and 270°. The rotational frequency can be between 0 and 60 cycles per minute. Other translational and rotational distances and frequencies are possible.

The structure for imparting translational and rotational motion to the digestion chamber can be any suitable structure. The drive mechanism can be electric, mechanical, electromechanical, pneumatic, hydraulic, or other suitable structures. Electric solenoids can be designed to impart rotational and translational motion to the digestion chamber.

An orbital shaker for cell extraction 10 is shown in FIGS. 1–7. A digestion chamber 14 is provided for retaining the organ or other tissue from which cells are to be extracted. As is known in the art, the digestion chamber 14 can be provided with inlet and outlet ports for a digestive medium and other structure for facilitating the cell extraction process. A heating surface 18 can be provided for heating the medium by wrapping a supply conduit (not shown) around the heating surface 18 upstream of the connection to the digestion chamber 14. The digestion chamber 14 is mounted an engagement arm 22 which can extend through a suitable opening 26 in the housing 30. A chamber clamp 34 can be provided on the engagement arm 22 for engaging the digestion chamber 14. The engagement clamp 34 permits removal of the digestion chamber 14 for servicing during the extraction process and for cleaning and sterilization.

Translational motion can be imparted by suitable structure such as motor 40. The translational motor 40 rotates plate 44 which causes arms 48 to pivot. Arms 48 are joined to auxiliary link 52 which is pivotally mounted on shaft 56. Pivoting of the arms 48 causes the auxiliary link 52 to pivot. Auxiliary link 52 is pivotally joined to extension link 60 at a pivot 64. Extension link 60 is joined to drive link 68 at a pivot 72. Drive link 68 is pivotally connected to bracket 74 at a pivot 80. Engagement arm 22 passes through an aperture in bracket 74. Drive link 68 is pivotally mounted on support bar 84. A long link 88 can be pivotally mounted to support bar 84 and joined to drive link 68 by connection member 92. Long link 88 is connected to rear bracket 76. Engagement arm 22 passes through an aperture in rear bracket 76.

Pivoting of the auxiliary link 52 causes reciprocating movement of the extension link 60 and drive link 68, which in turn causes reciprocating movement of front bracket 74 and rear bracket 76. Engagement arm 22 is thereby reciprocated in a translational movement.

The translational frequency is controlled by electronically adjusting the speed of the motor 40. The amplitude is varied by adjusting the effective length of the arm 48. The oscillating block 205 is attached to fly wheel 209 of motor 40. The effective length of arm 48 is changed by the rotation of screw 204 that in turn moves the motor 40 and oscillating block 205 towards or away from the pivoting point 207 of arm 48. This will adjust the throw of auxiliary link 52. The screw 204 is rotated by motor 206 that is electronically controlled from the control panel.

It is sometimes preferable that the digestion chamber be subjected to rotational motion as well as translational motion. The engagement arm 22 and clamp 34 can also be rotated. This can be accomplished by suitable structure. A rotational motor 100 rotates disc 104. A connector 108 is pivotally connected to a link 112 which is pivotally connected to a gear drive link 116. Gear drive link 116 is connected to gear 120. Gear 120 engages drive gear 124. Rotation of drive gear 124 rotates pulley 128 causing belt 132 to rotate pulley 134. Pulley 134 is joined to a shaft 138, and rotation of the shaft 138 causes rotation of pulley 142 which is also mounted to shaft 138. Support links 144, 146 can be pivotally mounted between shaft 138 and support shaft 150. A member 155 can secure support link 144 and 146 together.

Rotation of the pulley 134 under the influence of belt 132 causes rotation of pulley 142 and corresponding movement of belt 158. Belt 158 extends to a pulley 162 that is connected to engagement arm 22. Movement of the pulley 162 thereby causes rotation of the engagement arm 22 and engagement clamp 34.

Figure 8:
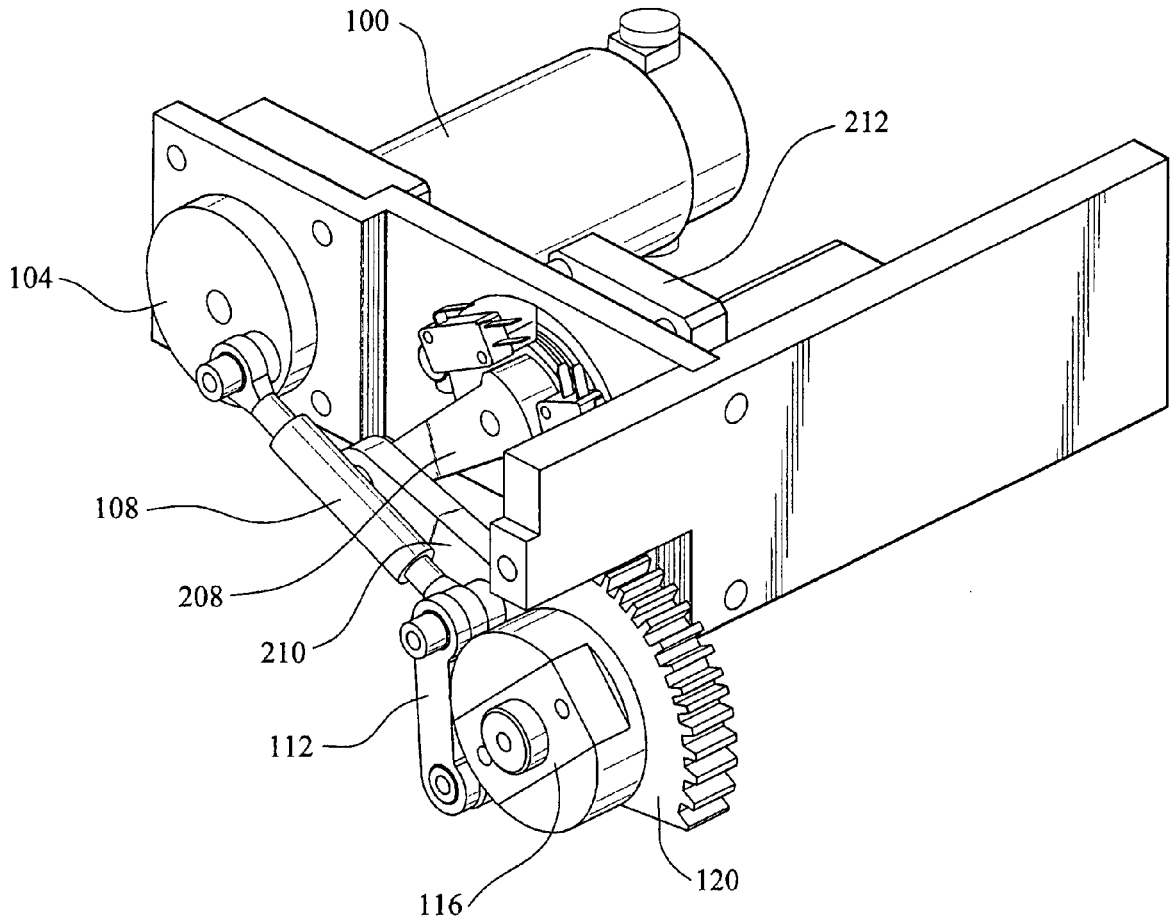
FIG. 8 is a perspective view of a rotational stroke adjustment mechanism.

The rotational frequency is controlled by electronically adjusting the speed of the electric motor 100. The rotational amplitude is changed by the rotation of arm 208, as shown in FIG. 8. Movement of rotating arm 208 downward from the position shown in FIG. 8 will cause link 210 to also move downward, which will reduce the stroke length. By rotating arm 208, the pivot point of arm 210 is changed thereby changing the oscillating stroke. The rotation of arm 208 is accomplished by electric motor 212 that is controlled by the rocker switch 214 situated on the control panel 170.

Suitable controls can be provided through a control panel 170. The control panel 170 can have controls 174 for translational stroke length and controls 176 for rotational stroke length. Control 180 can be provided to vary translational stroke frequency and control 184 can be provided to vary the rotational frequency. Controls 188 can be provided for adjusting the temperature of the heater 18. A display 192 can be provided to monitor temperature within the chamber 14. It will be apparent that the translational and rotational motion can be imparted to the digestion chamber 14 through a number of different mechanisms. In another embodiment, suitable solenoids can replace the mechanical linkages and pulleys to provide translational and rotational movement of the digestion chamber.

This invention can be embodied in other forms without departing from the spirit or essential attributes thereof and, accordingly, reference should be had to the following claims rather than the foregoing specification as indicating the scope of the invention.

We claim:

1. An orbital shaker for cell extraction, comprising:

an enclosed digestion chamber having a digestion medium therein, and at least one inlet port receiving digestion medium from a supply conduit, and at least one outlet port for evacuating digestion medium from the digestion chamber;

engagement structure for engaging said digestion chamber;

translational drive structure for translating the digestion chamber;

structure for adjusting translation characteristics of said translational drive structure, said translation characteristics comprising at least one of the translation distance and the translation oscillation frequency;

rotational drive structure for rotating the digestion chamber;

structure for adjusting the rotational characteristics of said rotational drive structure, said rotational characteristics comprising at least one of the included angle of rotation and the frequency of rotation; and said translational drive structure and said rotational drive structure being independently controllable.

2. The orbital shaker of claim 1, wherein said translational drive structure translates said digestion chamber between about 1" and about 5".

3. The orbital shaker of claim 1, wherein said translational drive structure oscillates said digestion chamber.

4. The orbital shaker of claim 3, wherein said translational drive structure comprises means for oscillating said digestion chamber at an oscillation frequency of between about 0 and 250 cycles per minute.

5. The orbital shaker of claim 1, wherein said rotational drive structure comprises means for rotating said digestion chamber through an included angle, said included angle being about 0° to about 270°.

6. The orbital shaker of claim 1, wherein said rotational drive structure comprises means for rotating said digestion chamber at a frequency of between about 0 and 60 cycles per minute.

7. The orbital shaker of claim 1, further comprising structure for controlling the temperature of a liquid prior to said liquid entering said digestion chamber.

8. The orbital shaker of claim 1, further comprising clamping structure for clamping said digestion chamber.

9. The orbital shaker of claim 1, further comprising structure for independently adjusting the translation distance, the translation oscillation frequency, the angle of rotation, and the frequency of rotation.

10. The orbital shaker of claim 1, further comprising at least one digestion enhancer within said digestion chamber.

11. The orbital shaker of claim 10, wherein said digestion enhancer is a marble.

* * * * *